US007591728B2

(12) United States Patent
Gioia et al.

(10) Patent No.: US 7,591,728 B2
(45) Date of Patent: Sep. 22, 2009

(54) ONLINE GAMING SYSTEM CONFIGURED FOR REMOTE USER INTERACTION

(75) Inventors: Gene George Gioia, Wheat Ridge, CO (US); Andrew Nicholas Gioia, Wheat Ridge, CO (US); Brendan Michael Fogarty, San Marcos, CA (US)

(73) Assignee: Gioia Systems, LLC, Denver, CO (US)

( * ) Notice: Subject to any disclaimer, the term of this patent is extended or adjusted under 35 U.S.C. 154(b) by 463 days.

(21) Appl. No.: 11/174,273

(22) Filed: Jul. 1, 2005

(65) Prior Publication Data

US 2007/0004499 A1 Jan. 4, 2007

(51) Int. Cl.
*G06F 17/00* (2006.01)
*G06F 19/00* (2006.01)

(52) U.S. Cl. ..... 463/42; 463/11; 463/12; 463/13; 463/40; 463/41; 273/138.1; 273/148 R; 273/149 R; 273/149 P

(58) Field of Classification Search ..... 463/11–13, 463/40–42; 273/138.1, 148 R, 149 R, 149 P
See application file for complete search history.

(56) References Cited

U.S. PATENT DOCUMENTS 2,714,510 A * 8/1955 Oppenlander et al. ... 273/149 R
3,944,230 A * 3/1976 Fineman ..... 273/149 R
4,339,798 A * 7/1982 Hedges et al. ..... 463/26
4,467,424 A * 8/1984 Hedges et al. ..... 463/26
4,531,187 A * 7/1985 Uhland ..... 463/12
4,667,959 A 5/1987 Pfeiffer et al.
4,969,648 A * 11/1990 Hollinger et al. ..... 273/149 R
5,000,453 A 3/1991 Stevens et al.
5,114,153 A 5/1992 Rosenwinkel et al.
5,382,024 A * 1/1995 Blaha ..... 273/149 R
5,397,133 A 3/1995 Penzias (Continued)

FOREIGN PATENT DOCUMENTS

GB 1 376 790 12/1974

(Continued)

OTHER PUBLICATIONS

Robert C. Hannum, Ph.D., "Randomness Analysis of Gioia Systems Cut N' Shuffle Card Shuffler," Department of Statistics & Operations Technology, University of Denver, May 2, 2008, pp. 1-21.

(Continued)

*Primary Examiner*—Peter DungBa Vo
*Assistant Examiner*—Milap Shah
(74) *Attorney, Agent, or Firm*—Banner & Witcoff, Ltd.

(57) ABSTRACT

The present invention provides systems and methods relating to a physical gaming system that may host remote players. According to one embodiment of the invention, physical cards are utilized in a gaming environment that may be played remotely over a network. The cards include at least one identifier that may be read upon the card being dealt. The identifier may contain information that is remotely communicated to a player. In one embodiment, a video image of the card is shown to a player. The "cards" of the present invention are not limited to traditional playing cards, but rather may be of any shape and/or three-dimensional, such as circular balls.

12 Claims, 4 Drawing Sheets

U.S. PATENT DOCUMENTS

| | | | | |
|---|---|---|---|---|
| 5,692,748 | A | 12/1997 | Frisco et al. | |
| 5,762,552 | A * | 6/1998 | Vuong et al. | 463/25 |
| 5,770,533 | A * | 6/1998 | Franchi | 463/42 |
| 5,800,268 | A | 9/1998 | Molnick | |
| 5,823,879 | A | 10/1998 | Goldberg | |
| 5,830,067 | A * | 11/1998 | Graves et al. | 463/40 |
| 5,989,122 | A | 11/1999 | Roblejo | |
| 6,001,016 | A * | 12/1999 | Walker et al. | 463/42 |
| 6,165,069 | A * | 12/2000 | Sines et al. | 463/12 |
| 6,250,632 | B1 | 6/2001 | Albrecht | |
| 6,267,248 | B1 | 7/2001 | Johnson et al. | |
| 6,346,044 | B1 | 2/2002 | McCrea, Jr. | |
| 6,508,709 | B1 * | 1/2003 | Karmarkar | 463/42 |
| 6,575,834 | B1 * | 6/2003 | Lindo | 463/40 |
| 6,582,301 | B2 | 6/2003 | Hill | |
| 6,588,751 | B1 | 7/2003 | Grauzer et al. | |
| 6,651,982 | B2 | 11/2003 | Grauzer et al. | |
| 6,676,127 | B2 | 1/2004 | Johnson et al. | |
| 6,679,777 | B2 | 1/2004 | Pfeiffer | |
| 6,729,621 | B2 | 5/2004 | Moody | |
| 6,755,741 | B1 | 6/2004 | Rafaeli | |
| 6,889,979 | B2 | 5/2005 | Blaha et al. | |
| 6,892,224 | B2 | 5/2005 | Strahm | |
| 6,898,579 | B1 | 5/2005 | Durfee | |
| 6,991,540 | B2 | 1/2006 | Marlow | |
| 2002/0068635 | A1 * | 6/2002 | Hill | 463/47 |
| 2002/0094869 | A1 | 7/2002 | Harkham | |
| 2002/0113368 | A1 * | 8/2002 | Hessing et al. | 273/149 R |
| 2002/0147042 | A1 * | 10/2002 | Vuong et al. | 463/40 |
| 2003/0013510 | A1 | 1/2003 | Vuong et al. | |
| 2003/0144052 | A1 * | 7/2003 | Walker et al. | 463/20 |
| 2003/0195025 | A1 | 10/2003 | Hill | |
| 2004/0023722 | A1 | 2/2004 | Vuong et al. | |
| 2004/0067794 | A1 * | 4/2004 | Coetzee | 463/42 |
| 2004/0224777 | A1 * | 11/2004 | Smith et al. | 463/47 |
| 2005/0051965 | A1 | 3/2005 | Gururajan | |
| 2006/0205508 | A1 * | 9/2006 | Green | 463/40 |
| 2007/0015583 | A1 * | 1/2007 | Tran | 463/40 |
| 2007/0178955 | A1 * | 8/2007 | Mills | 463/13 |

FOREIGN PATENT DOCUMENTS

WO 99/19027 A2 4/1999

OTHER PUBLICATIONS

David Ross, "Real Cards, Online Poker," Cutting Edge, Global Gaming Business Magazine, Retrieved at: ggbmagazine.com/articles/Real_Cards_Online_Poker, vol. 7, No. 9, Sep. 2008.

iGamingBusiness.com, "Gioia Nominated For Innovator Award," Gaming Business, published Jan. 20, 2009, retrieved from http://www.igamingbusiness.com/article-detail.php?articleID=19761.

pokerworks.com, "2008 European Poker Awards Nominees Announced," contributed by Jennifer Newell, Dec. 23, 2008, retrieved from http://pokerworks.com/poker-news/2008/12/23/european-poker-award-nominees-2008.html.

* cited by examiner

ONLINE GAMING SYSTEM CONFIGURED FOR REMOTE USER INTERACTION

TECHNICAL FIELD

This invention relates to gaming systems, and more particularly, to an apparatus and methods relating to a physical gaming system that may host remote players.

BACKGROUND OF THE INVENTION

The entertainment industry continues to flourish as the public ceaselessly demands an increasing array of talent and innovation to help relax from the tumultuous reality, or simply to satisfy their specific wants. Casino-type games and other entertainment forms that combine chance with skill have achieved a significant niche among a subset of society, both in the technological and traditional realm. Particularly in today's technological computer era, arcade games and other electronic devices have become very popular. As electronic games have increased in popularity, more casino-type games are enjoyed in a pure electronic format. One example is the usage of video poker.

In concept, video poker is enjoyed similar to traditional poker games and is designed to replicate many aspects of a hand of poker. In some formats, the player is not attempting to beat another player's hands or against a dealer's hand; the player is simply attempting to achieve the highest ranking poker hand possible from the cards displayed to the player. The higher the ranking of the poker hand achieved by the player, the greater the player's winnings based on the number of coins, tokens or credits wagered by the player. Typically, a payout schedule is posted on the gaming machine to advise the player of the payoffs available for certain winning card combinations.

The video poker systems generate the deck or decks of cards based on an algorithm or a form of a random number generator, electronically produces visual representations of cards on a display device, and allows a user to determine which card to "hold" and which cards to "discard". The system then displays visual representations of replacement cards for the cards the player has discarded. The player wins or loses based on conventional poker hand rankings for the resulting five card hand.

While many aspects of the card game are recreated with the above mentioned systems, they lack several aspects of traditional card games and are prone to alteration and deception. For example, users of the electronic systems do not know if the machine really creates an accurate "deck" of cards, since there are no physical cards to verify. The users have no idea what algorithm is being utilized to "randomly" draw the cards and cannot be certain the software has not been altered to fix the odds.

Thus there is a need for methods and systems that enable players to enjoy amusement-type card games with assurance of accuracy and fairness. There also is a need to recreate aspects of traditional aspects of "live-dealing" in a card game. These and other advantages are successfully incorporated in embodiments of the present invention without sacrificing the element of amusement that many desire.

SUMMARY OF THE INVENTION

Aspects of the invention relate to gaming systems, and more particularly, to an apparatus and methods relating to a physical gaming system that may host remote players. According to one aspect of the invention, physical cards are utilized in a gaming environment that may be played remotely over a network. In one embodiment, the physical cards are traditional poker-style gaming cards. The cards include at least one identifier that may be read upon the card being dealt. The identifier may contain information that is remotely communicated to a player. In one embodiment, a video image of the card is shown to a player. The "cards" of the present invention are not limited to traditional playing cards, but rather may be of any shape and/or three-dimensional, such as circular balls. Indeed, any item that may be shuffled, dealt, and reorganized may be a card according to the present invention.

In certain embodiments of the invention, the present invention can be partially or wholly implemented with a computer-readable medium, for example, by storing computer-executable instructions or modules, or by utilizing computer-readable data structures.

Of course, the methods and systems of the above-referenced embodiments may also include other additional elements, steps, computer-executable instructions, or computer-readable data structures.

Additional features and advantages of the invention will be apparent upon reviewing the following detailed description.

DETAILED DESCRIPTION OF THE INVENTION

Introduction

Figure 1:
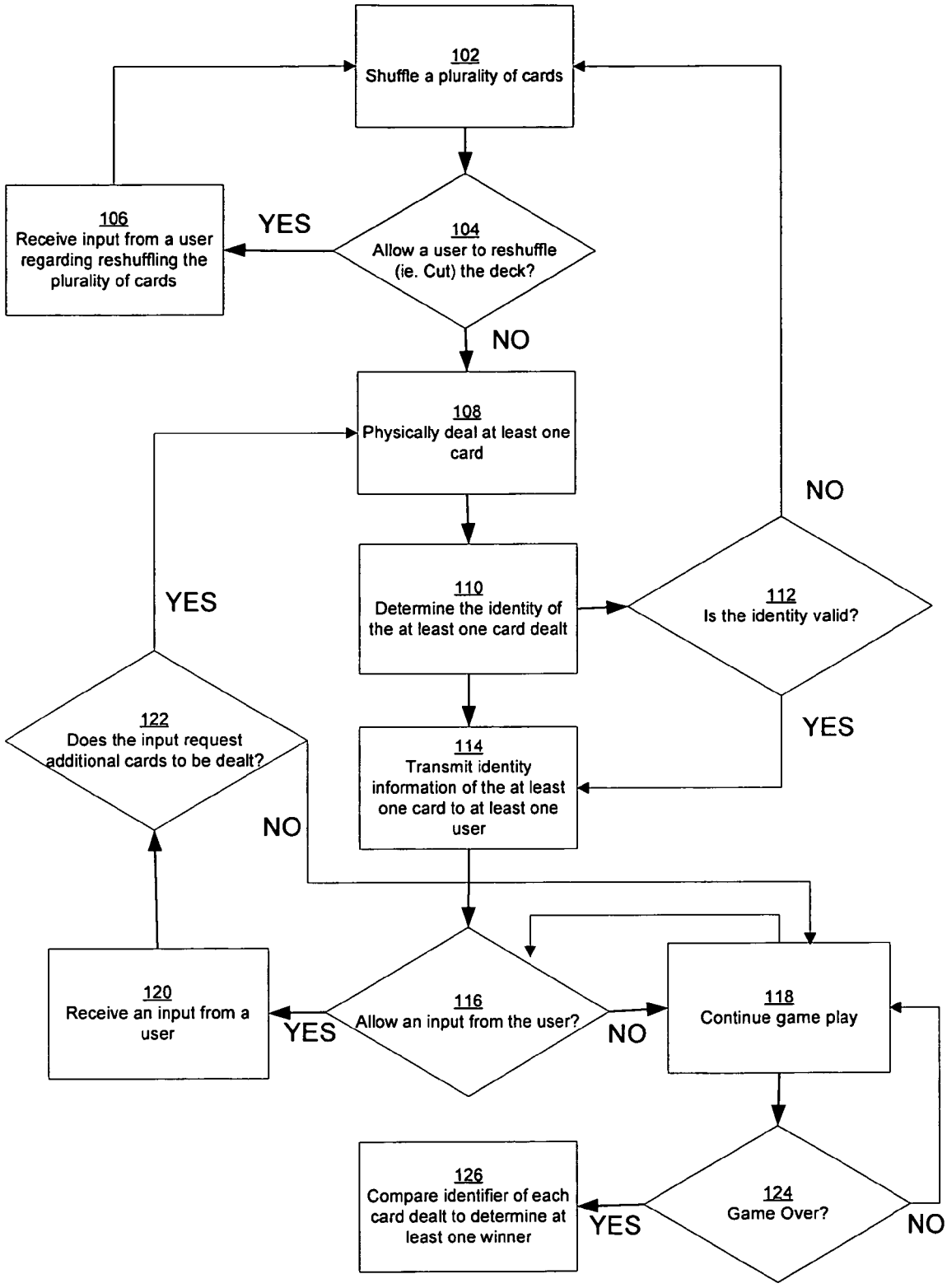
FIG. 1 depicts one exemplary method of playing a card game according to one embodiment of the present invention.

FIG. 1 illustrates one exemplary method of playing a card game according to one aspect of the present invention. As one skilled in the art will appreciate, the exemplary method may be performed with a variety of gaming systems; however, to aid the reader in understanding the invention, the method of playing the exemplary card game will be illustrated by way of illustrating the exemplary embodiments disclosed in FIGS. 2-4. Moreover, the disclosed method may comprise more or fewer steps, as it is understood the exemplary steps illustrate one embodiment.

As shown in FIG. 1, a plurality of cards are shuffled in step 102. Step 102 involves the physical movement of a plurality of cards, such as deck of cards 202. Step 102 may be performed through mechanical or electrical mechanisms; however, the cards are physically shuffled. Therefore, the final order of the cards is not determined solely by a random number generator or algorithm. One skilled in the art will realize that one or more embodiments may utilize an algorithm to determine the longevity of the shuffle or the like, however, the final order of the cards cannot be accurately predicted upon applying one predetermined algorithm. Shuffling device 204 illustrates one exemplary automatic shuffling device according to one embodiment of the present invention that may be used to perform step 102. In one embodiment, the shuffling device 204 is configured to house a plurality of gaming cards, such as standard poker playing cards. In other embodiments, the shuffling device is configured to house odd shaped or three-dimensional "cards", such as balls. Indeed, one embodiment of the invention may utilize a chamber to house the cards, wherein pressurized air is introduced into the chamber having the plurality of cards. The pressurized air will alter the arrangement of the plurality of cards in a random fashion. This method of shuffling is especially advantageous when utilizing three-dimensional cards, such as balls. In one embodiment, the cards are shuffled for a predetermined length of time, whereas in another embodiment, a user input may determine the longevity of the shuffle. A remote user can provide an electronic or mechanical input that controls the physical shuffling of the deck of cards as described in more detail below. Indeed, while the embodiment involves a physical deck of cards, remote users may take part in the game.

Figure 3:
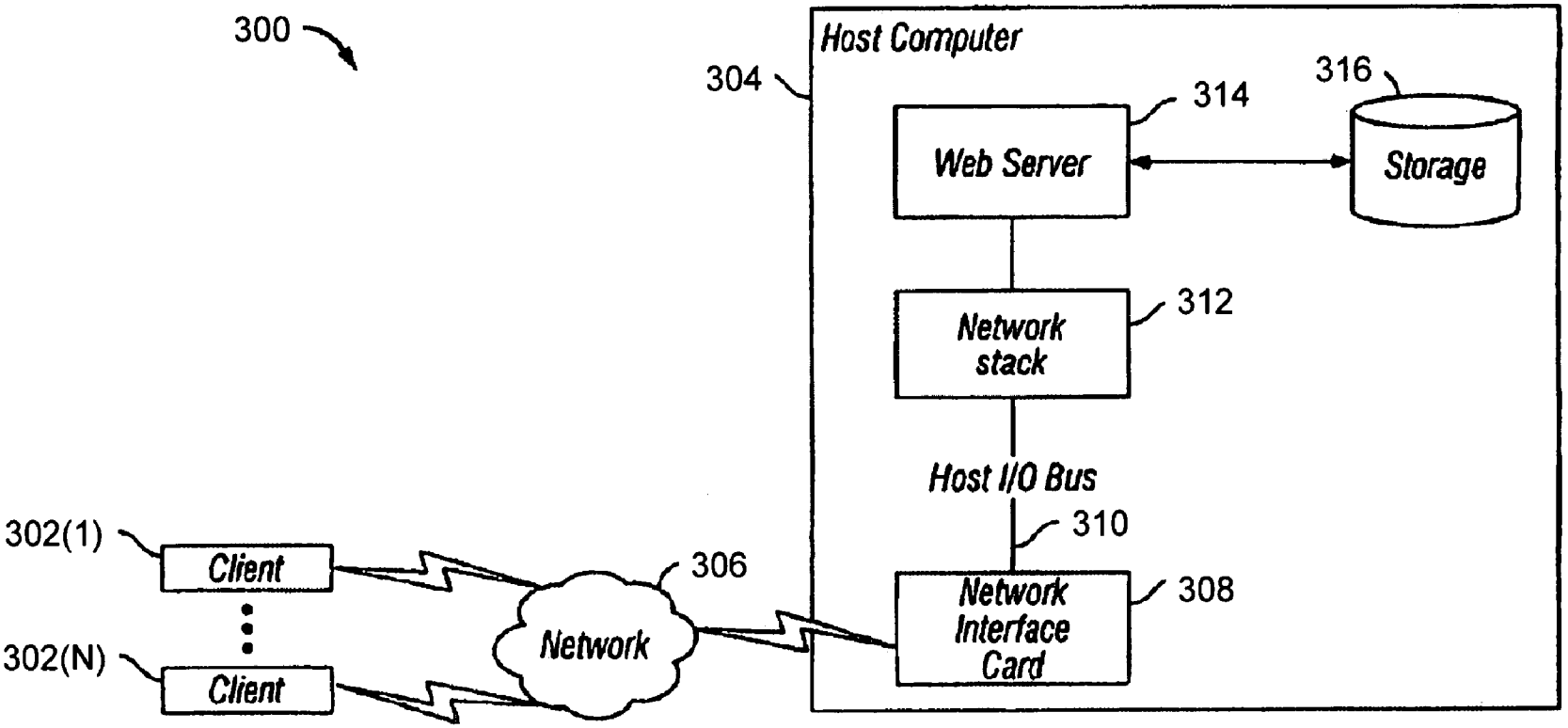
FIG. 3 illustrates one possible network configuration having a client/server network setup that may be used with select embodiments of the present invention.

One embodiment of the invention allows remote players to participate in the physical game through a network, such as the World Wide Web. FIG. 3 illustrates one possible network configuration (300) having a client/server network setup. In the network configuration 300, clients 302(1)-302(N) can each request information from a host computer 304 across a network 306. (N represents a whole number.) The client 302 (1), for example, may send a request across the network 306 to join a game session. In one embodiment, the request may arrive at the host computer 306 at a network interface card (NIC) 308. From the NIC 308, the request can travel along an input/output (I/O) bus 310 and through a network stack 312 to a web server 314 running web server software. The web server may also comprise software to allow game play or be electronically connected to a computer-readable medium having the necessary software to allow game play.

The web server 314 handles the request (including any necessary connection setup and information retrieval) and, if necessary, reads information from a local storage mechanism 316 such as a buffer or a data cache. The web server 314 may then return any content requested by the client 302(1) to the client 302(1), with the content traveling through the network stack 312, the I/O bus 310, the NIC 308, and the network 306. Likewise, clients 302(1)-302(N) can each send and receive information to each other, such as for example, chatting and/or card information.

Figure 4:
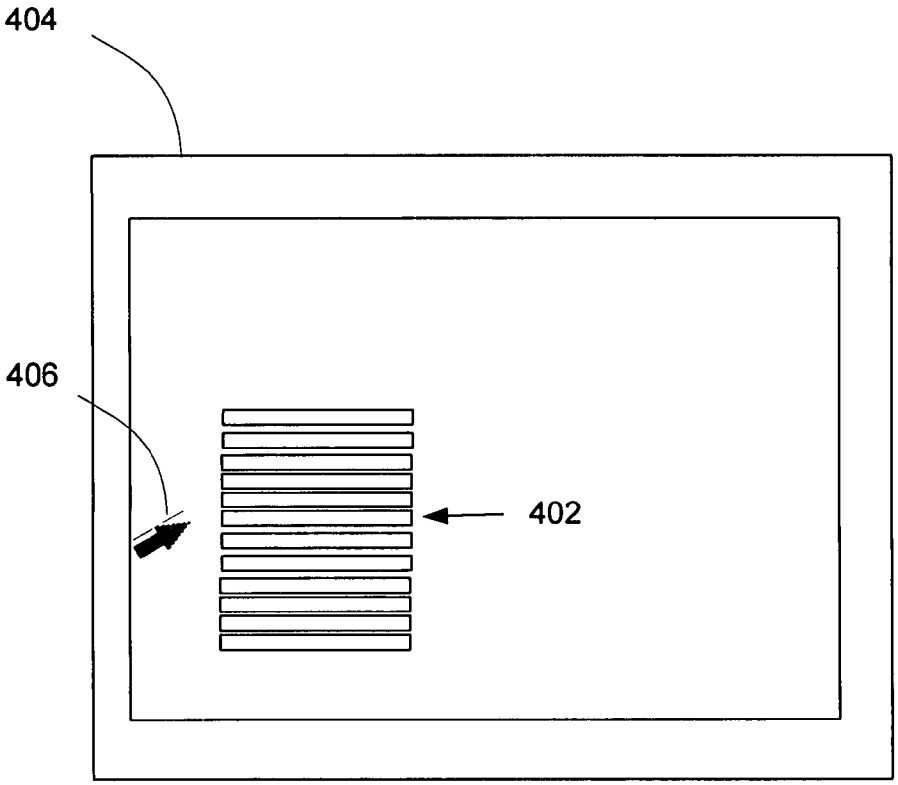
FIG. 4 depicts one exemplary method of allowing a user to shuffle or otherwise rearrange the arrangement of the cards according to one embodiment of the present invention.

In some card games, it is customary to allow at least one player to cut the deck, therefore optional step 104 may be implemented to determine if the game allows reshuffling or rearrangement of the cards by a user. If the employed embodiment permits a user to cut the deck, step 106 receives an input from a user regarding the reshuffling the deck of cards. FIG. 4 shows one exemplary method of allowing a user to shuffle or otherwise rearrange the arrangement of the cards. A graphical representation of the deck of cards, such as representation 402 can be displayed on an output device, such as monitor 404 operatively connected to a client 302(1)-(N). The user may provide an input through an input device to select a location to "cut" the deck. For example, arrow 406 may be positioned to select a specific card within the graphical representation of the deck of cards 402. The user may be allowed to choose any individual card within the graphical representation 402 which corresponds to a physical card or sections of cards within the deck of cards 202. Once selected, the input is transmitted through the network, for example as described in relation to FIG. 3, to the shuffling device 204, where the deck 202 is physically "cut" according to the user input. In other embodiments, shuffling device 204 may shuffle the deck 202 until a user input is received. For example, step 102 could be repeated.

In step 108, a card is physically dealt from the deck of cards 202. In one embodiment, the top card of the deck will be dealt; however, one skilled in the art will appreciate that other embodiments may draw a card at random. For example, embodiments having balls in a pressurized chamber may be randomly selected. While the cards are physically dealt, select embodiments may not remove the card from the shuffling device. Indeed, in one embodiment, the card is merely transferred to another section or compartment of the shuffling device 204. Yet in other embodiments, the card is dealt from a device that is separate from the shuffling device 204. In step 110, the identity of the dealt card is determined. In one embodiment, steps 108 and 110 may occur substantially simultaneously, wherein the identity of the card is determined as it is physically dealt.

Figure 2:
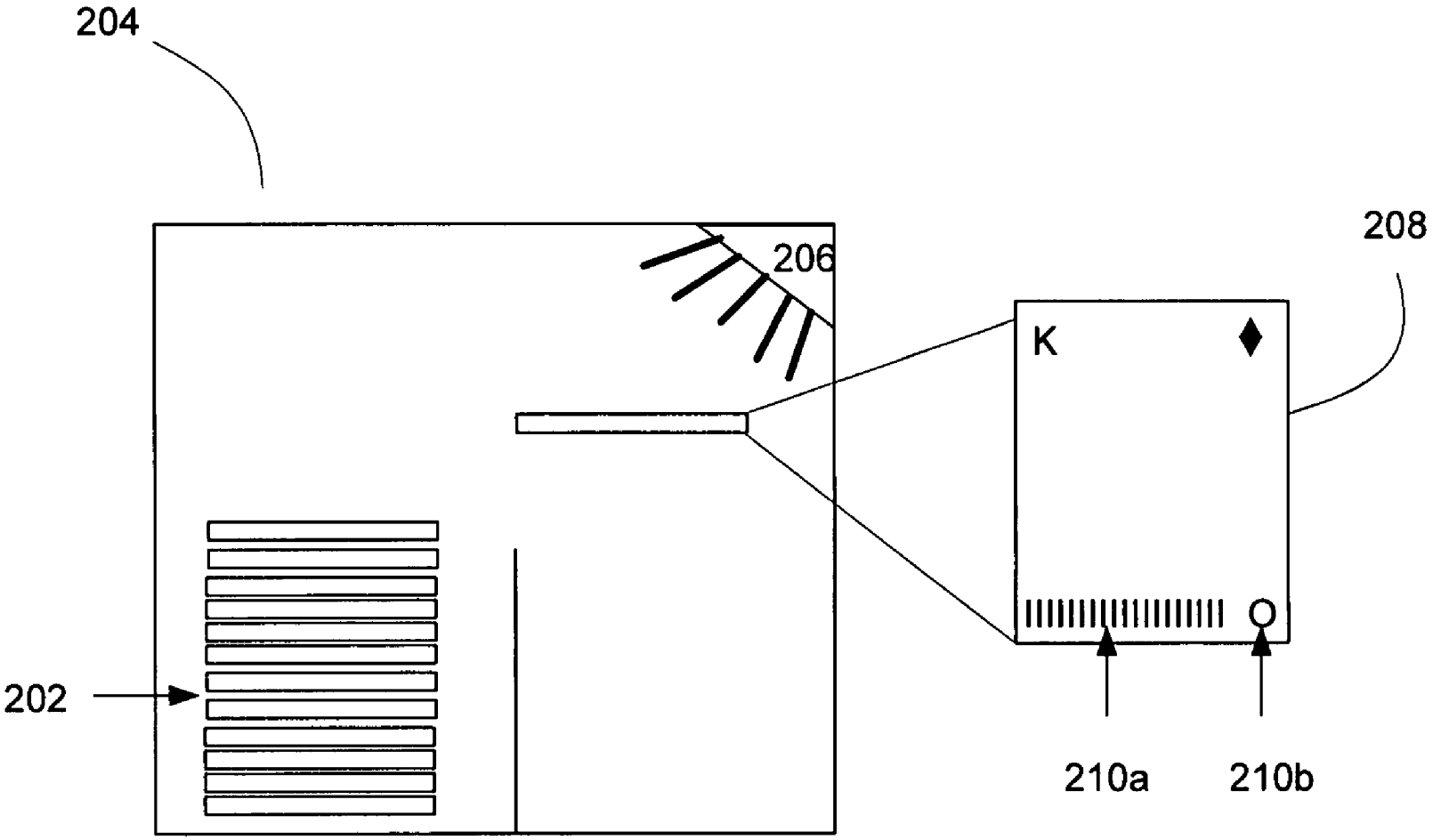
FIG. 2 depicts an exemplary card shuffling and dealing system according to one embodiment of the present invention.

As shown FIG. 2, the shuffling device may also comprise a card reader, such as card reader 206. Yet in other embodiments, the card reader is external to the shuffling device. The card reader may determine the dealt card's identity based on the presence of at least one identifier. As shown in FIG. 2, dealt card has 208 a plurality of identifiers 210*a*, 210*b*. As used herein, an identifier can be any marking, attribute, and/or property of a card used in conjunction with the card reader 206 to identify the card. In one embodiment, the identifier contains information such as a source code for determining which deck or subset of cards the card originated from. For example, identifier 210*a* may comprise a scannable code, such as a bar code that is readable by card reader 206. Yet in other embodiments, reader 206 may be an RFID reader configured to read identifier 210*b*. In still yet other embodiments, the identifier 210*a* may comprise at least one physical alteration to the card, such as for example, a notch, groove, or extrusion, that may be used with card reader 206 to identify the card.

The identifiers 210*a*, 210*b* may comprise a plurality of information, such as but not limited to: a numerical value of the card and the "suit" (i.e., club, spade, heart) or other subset classification of the card. Indeed, in one embodiment, the identifier 210*a* may also aid in ensuring the fairness and accuracy of the game. For example, identifier 210*a* may also comprise information regarding the origination of the dealt card. This would be especially advantageous for games utilizing multiple decks. For example, if 3 decks are utilized for a particular game, one identifier, for example, identifier 210*a*, may comprise information regarding which deck the card originated from to ensure more or less than 3 decks were not being used and/or became improperly combined. In such embodiments, optional step 112 may be implemented to ensure validity of the cards. For example, if a game is utilizing decks 001, 002, and 003, the card reader 206 may be configured to discard any card not from decks 001, 002, and 003. In yet another embodiment, the detection not belonging to decks 001, 002, and 003 may cause the termination of the current game and a new deck or decks of cards will be shuffled to initiate a new game. In still yet another embodiment, the identity information retrieved from an identifier, such as identifier 210*a* may be stored in an electronic medium for later analysis. For example, if the odds of dealing an ACE of HEARTS is 1/52, but the card reader has detected that particular card has been dealt 5 times in the last 10 deals, an optional step may be implemented to require inspection of the card reader 206 and/or the card shuffler 204 before more games are conducted.

In yet another embodiment, conventional attributes of typical playing cards may be used as identifiers. For example, the card reader 206 may comprise a video camera that identifies the card based on at least one visual representation. In the illustrated embodiment, visual identifiers may comprise the "K" representing the card is a "KING" and a visual representation of a "Diamond", thereby the card will be interpreted by the card reader to be a "King of Diamonds". In yet another embodiment utilizing conventional attributes of cards, a card reader, such as reader 206 may further comprise a video camera operatively coupled to a computer to further identify the dealt card 208. For example, in one embodiment the reader is a camera coupled to a computer having software to recognize the characters or letters on the card 208, such as Optimal Character Recognition ("OCR") or the like.

While step 210 has been described in relation to the dealing of one card, one skilled in the art will recognize that the dealing of multiple cards to one or more players is within the scope of the invention. Moreover, one in the art will understand that a plurality of identifiers, such as identifiers 210*a*, 210*b* may be used simultaneously to identify a card. This may be especially advantageous in embodiments attempting to simulate the "real feel" of a live game while increasing the accuracy and efficiency of administering the game. For example, identifier 210*b* may be used to electronically track the game while a still or video camera may be used to capture the actual card dealt to increase the realistic gaming experience.

In step 114, the identity of the dealt card is transmitted to at least one user. Transmission may be performed through a variety of mediums, such as the network environment illustrated in FIG. 3. When and to which players the identity of a particular card is transmitted to may be determined according the preset rules in the game play. For example, in one embodiment employing a "Blackjack"-style game, the identity of at least one of the dealts cards, such as the face-down card dealt to the dealer will not be revealed to a player, until a player's turn has ended. In one such embodiment, step 116 may be implemented before step 114 to allow the player to provide an input, for example, to instruct the computer that the player does not wish to be dealt another card. As step 118 indicates, game play will continue according to the type of game being administered. If, however, the player does provide an input in step 120, step 122 maybe implemented to determine if the input request additional cards to be dealt. In one embodiment, if additional cards are to be dealt, step 108 may be re-implemented. Returning to step 118, game play will resume until it is determined at step 124 that the game is over. As one skilled in the art will understand, step 118 may incorporate any of the preceding steps or optional additional steps to continue to the game, such as for example, redealing cards, shuffling additional cards as needed, determining when and to whom the dealt cards are displayed to.

Step 118 will depend on the type of game implemented. For example, in Draw Poker, the conventional poker hand rankings that are winning combinations are a Royal Flush, a Straight Flush, a Four of a Kind, a Full House, a Flush, a Straight, a Three of a Kind, a Two Pair and a Pair of Jacks or Better, wherein a payout table is established based on the number of coins wagered by the player and the type of poker hand achieved. One skilled in the art will understand there are many poker formats used in poker. These poker game formats include, but are not limited to: Jacks (or even Tens) or Better Draw Poker, Bonus Poker, Double Bonus Poker, Double Double Bonus Poker, Super Double Bonus Poker, Triple Bonus Poker, Deuces Wild Poker, Jokers Wild Poker, Deuces and Jokers Wild Poker, Texas Holdem Poker, Omaha Hi Poker, Omaha Hi Lo Poker, Stud Poker Hi, and Stud Poker Hi Lo. One skilled in the art will realize that these and other games of the present invention may be played with a wagering system, wherein the wagering system may vary, such as limited and no limit stakes.

In yet other embodiments, other traditional card games may be employed, such as Black Jack, Caribbean Stud, or the like. In one embodiment, the system is configured to allow a user to choose among numerous game formats. The player may then make a wager based on upon that choice of game format. Once is it is determined game play has ended, step 126 may compare the identity of each card dealt to determine at least one winner.

While the exemplary embodiment has been discussed in broad terms of a networking environment, the invention, however, may be configured for personal gaming systems, such as Sony® Playstation® or Microsoft® Xbox®, handheld systems such as a Palm® or Treo®, among others, for example, cellular-based applications. In still yet further embodiments, the invention is configured for web-based applications that may be incorporated within or independent of cellular-based applications.

We claim:

1. A computer-readable medium comprising computer-executable instructions that when executed perform the steps of:

receiving a first electronic signal from one of a plurality of remote users, wherein the first electronic signal is configured to physically randomize a plurality of cards at a card shuffling device without the utilization of a random number generator, and wherein each card has at least one identifier;

receiving a second electronic signal configured to physically deal at least one card from the plurality of cards;

determining, with a computer device, the identity of the at least one card dealt by determining the at least one identifier of the at least one card;

transmitting a third electronic signal including identity information of the at least one card dealt through a network to at least one of the remote users; and receiving a fourth electronic signal from one of the plurality of remote users, the fourth signal electronically indicating a physical location within the plurality of cards to cut the plurality of cards, wherein the plurality of cards are physically cut at the location indicated.

2. The computer-readable medium of claim 1, wherein the at least one identifier is selected from the group consisting of: a barcode, an alteration of the surface of the card, RFID, and combinations thereof.

3. The computer-readable medium of claim 1, wherein the identity information is selected from the group consisting of: a unique card identifier, a source code, an image, a graphical representation of the card, and combinations thereof.

4. The computer-readable medium of claim 1, further comprising the step of:

receiving a fifth electronic signal from one of the plurality of remote users configured to cause the physical arrangement of some or all of the plurality of cards within control of the card shuffling device.

5. The computer-readable medium of claim 4, wherein the physical arrangement comprises dealing at least one card from the plurality of cards.

6. The computer-readable medium of claim 4, wherein the physical arrangement comprises collecting the at least one card dealt.

7. The computer-readable medium of claim 4, wherein the physical arrangement comprises shuffling at least a portion of the plurality of cards.

8. The computer-readable medium of claim 1, further comprising the step of:

comparing the transmitted identity information to the user with the at least one identifier on at least one card dealt to verify the accuracy of the game.

9. The computer-medium of claim 8, further comprising the steps of:

based on the result of comparing the transmitted identity information with the at least one identifier on the plurality of cards, automatically removing at least a portion of the plurality of cards in the card shuffling device; and introducing a second plurality of cards into the card shuffling device.

10. The computer-readable medium of claim 1, further comprising the steps of:

transmitting through the network to at least one of the plurality of remote users a fifth electronic signal configured to provide a graphical display of the plurality of cards to the at least one remote user, wherein the graphical display provides a representation of actual cards in the plurality of cards such that each card displayed to the remote user represent a physical card from the plurality of cards; and receiving through the network a sixth electronic signal including a selection of one card from the plurality of cards.

11. The computer-readable medium of claim 10, further comprising the step of:

physically cutting the plurality of cards at the card that represents the card selected by the remote user.

12. A computer-readable medium comprising computer-readable instructions that when executed perform the steps of:

receiving a first electronic signal from one of a plurality of remote users, wherein the first signal causes the physical randomization of a plurality of cards at a card shuffling device without the utilization of a random number generator, wherein each card has at least one identifier;

receiving a second electronic signal configured to physically deal at least one card from the plurality of cards;

determining, with a computer device, the identity of the at least one card dealt by determining the at least one identifier on the at least one card;

transmitting a third electronic signal including identity information of the at least one card dealt through a network to at least one of the remote users;

requiring receipt of a fourth electronic signal through the network from at least one of the plurality of remote users to prevent utilization of remote automated programs, wherein the signal comprises a user input selected from the group consisting of:

(i) a user input configured to physically cut the plurality of cards, thereby indicating the initiation point for distribution of cards to be physically dealt to one or more of the plurality of remote users; and (ii) a user input configured to indicate the at least one remote users does not wish to cut the plurality of cards; and initiating a game according to pre-defined rules that include the distribution of information of at least two cards of the plurality of cards in sequential order to one or more of the plurality of remote users.

* * * * *